US011986043B2

(12) United States Patent
Donovan et al.

(10) Patent No.: US 11,986,043 B2
(45) Date of Patent: May 21, 2024

(54) SHOE, ESPECIALLY SPORTS SHOE

(71) Applicant: PUMA SE, Herzogenaurach (DE)

(72) Inventors: Patrick Donovan, Fuerth (DE); Andreas Siegismund, Rueckersdorf (DE); Erwin Rammig, Hezogenaurach (DE)

(73) Assignee: PUMA SE, Herzogenaurach (DE)

( * ) Notice: Subject to any disclaimer, the term of this patent is extended or adjusted under 35 U.S.C. 154(b) by 13 days.

(21) Appl. No.: 17/046,689

(22) PCT Filed: Apr. 26, 2018

(86) PCT No.: PCT/EP2018/060819
§ 371 (c)(1),
(2) Date: Oct. 9, 2020

(87) PCT Pub. No.: WO2019/206423
PCT Pub. Date: Oct. 31, 2019

(65) Prior Publication Data

US 2021/0120906 A1 Apr. 29, 2021

(51) Int. Cl.

| | |
|---|---|
| ***A43B 1/04*** | (2022.01) |
| ***A43B 5/02*** | (2006.01) |
| ***A43B 23/02*** | (2006.01) |

(52) U.S. Cl.
CPC ..... *A43B 1/04* (2013.01); *A43B 5/02* (2013.01); *A43B 23/022* (2013.01); *A43B 23/0235* (2013.01)

(58) Field of Classification Search
CPC ..... A43B 1/04; A43B 5/02; A43B 23/022; A43B 23/0235; A43C 1/003
See application file for complete search history.

(56) References Cited

U.S. PATENT DOCUMENTS 5,319,869 A 6/1994 McDonald et al.
5,365,677 A * 11/1994 Dalhgren ..... A43B 1/04 36/3 A (Continued)

FOREIGN PATENT DOCUMENTS

CN 1642453 A 7/2005
CN 102573551 A 7/2012

(Continued)

OTHER PUBLICATIONS

English Language Translation of DE9113139U1 Provided by Patent Translate Powered by EPO and Google; WL Gore & Associates GmbH, Oct. 1991; English Language Translation dated Sep. 10, 2020.*

(Continued)

*Primary Examiner* — Alissa L Hoey
*Assistant Examiner* — Akwokwo Olabisi Redhead
(74) *Attorney, Agent, or Firm* — Quarles & Brady LLP

(57) ABSTRACT

A shoe includes a shoe upper and a sole which is connected with the shoe upper. The shoe upper includes a knitted structure which at least partially surrounds a foot of a wearer during intended use of the shoe. The knitted structure has a first set of openings arranged side by side along both a lateral and a medial side of the shoe upper. The knitted structure has a second set of openings arranged side by side along both a lateral and a medial side of the shoe upper. The first set of openings are at a first height level of the shoe, the second set of openings are at a second height level of the shoe, and the first height level is different than the second height level.

20 Claims, 5 Drawing Sheets

(56) References Cited

U.S. PATENT DOCUMENTS

Figure 1:
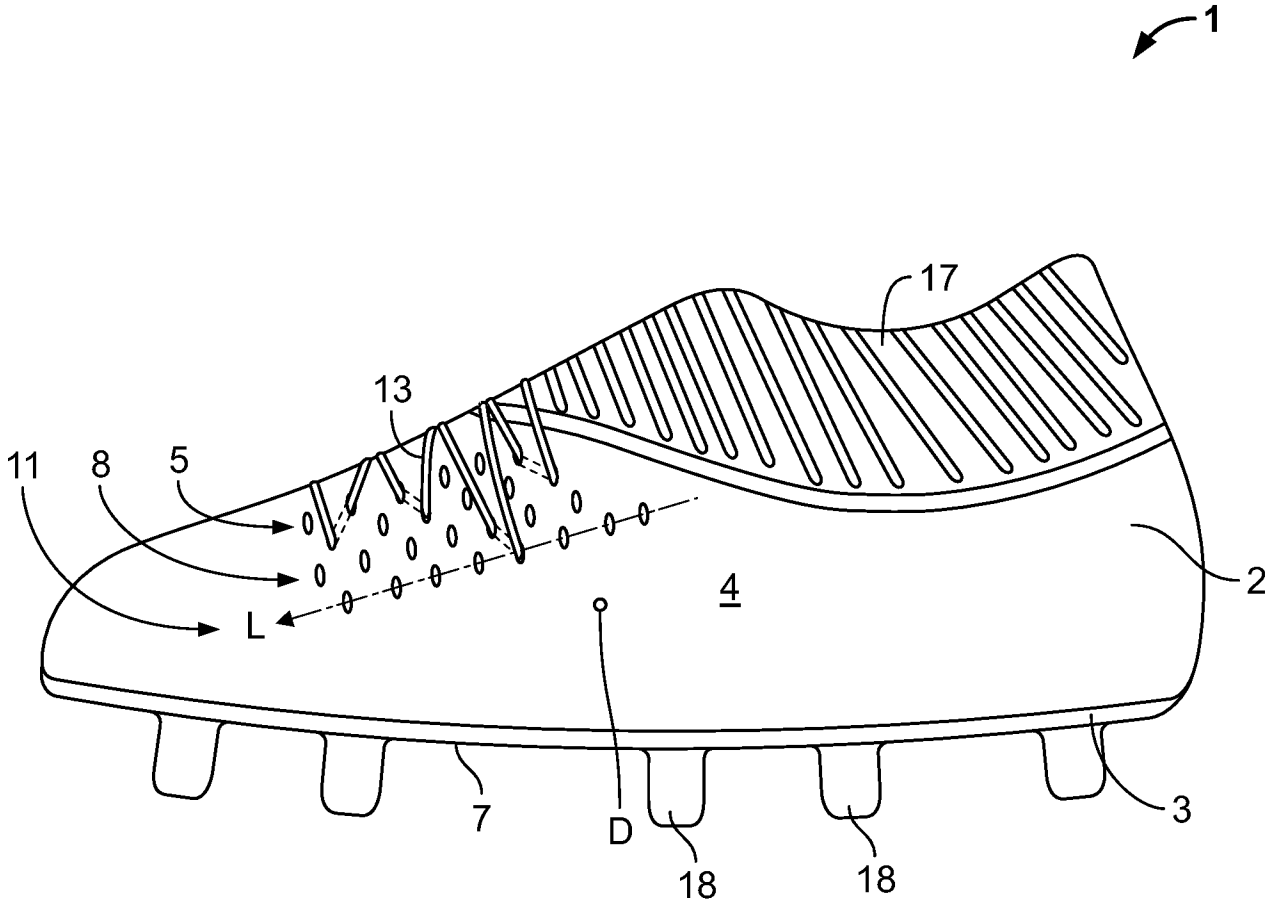

| | | | | |
|---|---|---|---|---|
| 9,392,835 | B2 * | 7/2016 | Dekovic | D04B 1/104 |
| 2005/0016023 | A1 * | 1/2005 | Burris | A43B 7/08 36/45 |
| 2007/0245595 | A1 | 10/2007 | Chen et al. | |
| 2008/0110048 | A1 * | 5/2008 | Dua | A43B 3/0031 12/146 C |
| 2012/0246973 | A1 * | 10/2012 | Dua | A43B 23/0255 36/83 |
| 2014/0068968 | A1 * | 3/2014 | Podhajny | A43B 23/0255 36/50.1 |
| 2014/0352173 | A1 * | 12/2014 | Bell | A43B 23/024 36/50.1 |
| 2015/0007451 | A1 * | 1/2015 | Bruce | A43B 23/0245 36/83 |
| 2015/0101212 | A1 | 4/2015 | Dekovic et al. | |
| 2015/0272274 | A1 * | 10/2015 | Berns | A43B 23/0225 36/84 |
| 2015/0342285 | A1 * | 12/2015 | Huffman | A43B 1/04 36/9 R |
| 2016/0331083 | A1 | 11/2016 | Jesato | |
| 2017/0156446 | A1 | 6/2017 | Yumiba et al. | |

FOREIGN PATENT DOCUMENTS

| | | | | |
|---|---|---|---|---|
| CN | 202714255 | U | 2/2013 | |
| CN | 203748765 | U | 8/2014 | |
| CN | 104413996 | A | 3/2015 | |
| CN | 106136418 | A * | 11/2016 | A43B 1/04 |
| CN | 106136418 | A | 11/2016 | |
| CN | 206659259 | U | 11/2017 | |
| DE | 9113139 | U1 | 4/1993 | |
| JP | 1994141909 | A | 5/1994 | |
| JP | 2005520611 | A | 7/2005 | |
| JP | 2016529036 | A | 9/2016 | |
| WO | 98/14081 | A1 | 4/1998 | |
| WO | 2017077021 | A1 | 5/2017 | |
| WO | 2018163090 | A1 | 9/2018 | |

OTHER PUBLICATIONS

Shanri, Leah, CN106136418A _English_Shanri.pdf, 2016, English Language Translation of CN106136418A Provided by Clarivate Analytics (Year: 2016).*

European Office Action, dated Feb. 5, 2021 (7 pages).

International Search Report of International Application No. PCT/EP2018/060819, dated Jan. 17, 2019, 4 pages.

Written Opinion of International Application No. PCT/EP2018/060819, dated Jan. 17, 2019, 6 pages.

The document is a textbook, entitled, "Women's Garment Craft," which is one of the series of teaching materials for clothing majors in some Chinese colleges and universities. It expounds the whole process and production skills of women's suit jackets. The cited part is relevant to ironing. It was Published by Donghua University Press in Dec. 2012, with ISBN code 978-7-5669-0193-4 (9 pages) (no English translation available).

Office Action from related Chinese Patent Application No. 201880092331.9 dated Feb. 7, 2022 (English Translation included).

Sheico Group.: "Ventiprene—Breathable Neoprene", Aug. 2, 2016 (Aug. 2, 2016), pp. 1-6, XP55880226, Retrieved from the Internet: URL:https://web.archive.org/web/20160802014606/https://www.spanflex.com.tw/english/fabrics/detail.php?dpid=13 [retrieved on Jan. 17, 2022].

EPO Communication from related European Patent Application No. 20216011.5 dated Jan. 24, 2022 (7 pages).

Office Action from corresponding Japanese Patent Application No. 2020-560248 dated Dec. 21, 2021 (11 pages) (English translation included).

* cited by examiner

SHOE, ESPECIALLY SPORTS SHOE

This application is a U.S. National Stage application, filed pursuant to 35 U.S.C. § 371, of international application no. PCT/EP2018/060819, filed on Apr. 26, 2018, the contents of which is incorporated herein by reference in its entirety.

The invention relates to a shoe, especially to a sports shoe and specifically to a soccer shoe, comprising a shoe upper and a sole which is connected with the shoe upper, wherein the shoe upper comprises a knitted structure which at least partially surrounds a foot of a wearer during intended use of the shoe.

Traditional football footwear is often water resistant and waterproof but does not provide sufficient ventilation for the wearer. Also the fit of the shoe at the foot of the wearer is often not satisfying due to the given lacing possibilities which are provided at such a shoe.

Thus, it is an object of the invention to propose a shoe, especially a sports shoe and specifically a soccer shoe of the generic kind which is waterproof but which allows a moisture transfer from the inner of the shoe to the outer side of the same. Furthermore, the fit of the shoe at the foot of the wearer should be optimized.

The solution of this object according to the invention is characterized in that the knitted structure comprises a first set of openings arranged side by side along a longitudinal extension of the shoe upper at a lateral side of the shoe upper and a first set of openings arranged side by side along the longitudinal extension of the shoe upper at a medial side of the shoe upper, wherein both sets of first openings are arranged in a defined first height level of the shoe upper measured from the bottom of the sole, that the knitted structure comprises a second set of openings arranged side by side along the longitudinal extension of the shoe upper at the lateral side of the shoe upper and a second set of openings arranged side by side along the longitudinal extension of the shoe upper at the medial side of the shoe upper, wherein both sets of second openings are arranged in a defined second height level of the shoe upper measured from the bottom of the sole, wherein the second height level is different from the first height level, and that a semi-permeable membrane is arranged between the foot of the wearer and the knitted structure which covers the openings of the knitted structure.

Preferably, the semi-permeable membrane allows the flow of moisture and/or water vapour from the foot of the wearer through the semi-permeable membrane and via the openings to the outer side of the shoe upper and prevents the transfer from moisture from the outer side of the shoe upper to the foot of the wearer.

The knitted structure can comprise at least one more set of openings arranged side by side along the longitudinal extension of the shoe upper at the lateral side of the shoe upper and at least one more set of openings arranged side by side along the longitudinal extension of the shoe upper at the medial side of the shoe upper, wherein both sets of additional openings are arranged in a defined height level of the shoe upper measured from the bottom of the sole.

The openings are preferably adapted to thread a lace through the same.

Preferably, the semi-permeable membrane consists of or comprises polysulphone (PSU), polyether sulphone (PES), polyether imide (PI), polytetrafluoroethylene (PTFE) or polyamide (PA).

The semi-permeable membrane is preferably connected with the shoe upper in a bottom region and in a top region and is not connected with the shoe upper in the region of the openings.

The shoe upper can comprise a reinforced structure which encloses at least a part of the openings. Thereby, the reinforced structure can be realized by a knitted structure which is added to the knitted base material of the shoe upper. The knitted reinforced structure has preferably a higher density of meshes than the knitted base material of the shoe upper and/or additional meshes which are added to the meshes of the knitted base material of the shoe upper. A further embodiment of this concept proposes that the knitted base material of the shoe upper has a base thickness and that the reinforced structure has an increased thickness; thereby, the increased thickness is preferably at least 120%, specifically preferred at least 140%, of base thickness.

A collar can be arranged in the instep region of the shoe upper. The stretchability of the collar is preferably at least twice as high, specifically preferred at least three times as high, as the stretchability of the material of the shoe upper beyond the collar (i. e. at the application of a tensile force (in Newton) to a defined test strip with a defined geometry of the respective material the elongation (in mm) is at least twice, preferably three times as high). The collar is preferably manufactured separately from the rest of the shoe upper and is connected with the same, preferably by means of a knitting or stitching process.

The shoe is preferably a soccer shoe, wherein the sole comprises a plurality of cleats.

Due to the proposed structure of the shoe a solution is available which guarantees water resistance of the shoe at one hand. At the other hand the article of footwear provides breathability to the wearer's foot through the incorporation of a membrane layer in the form of a semi-permeable membrane. This is combined with the knitted structure by which the shoe upper is realized. By doing so a customised fitting of the shoe at the foot of the user is available due to the possibility of a variety of lacing options. Thus, the proposed shoe is breathable and water resistant.

The semi-permeable membrane, i. e the membrane layer, can be laminated to a lining material which is also porous. The membrane layer allows moisture and water vapour to pass through in one direction (to the outside of the shoe) whilst restricting the flow of moisture in the opposing direction (into the inner of the shoe). The different sets of openings, which form basically an array of openings, facilitate this movement of moisture. Through laboratory testing of the membrane layer after assembly of the shoe it has been found that the membrane layer laminated to the textile provides a suitable solution for moisture management. The membrane can be attached to the upper component through stitching, which prevents any damage to the membrane layer.

The membrane can extend from the bottom end (distal end) of the shoe upper (close to the sole) to the upper end (proximal edge) of the same.

The shoe upper (collar excluded) is preferably made as a non-stretchable upper body which is attached to the stretchable collar. This guarantees that the shoe upper as such is quite stiff and not significant stretchable while the relatively elastic and stretchable collar allows the user of the shoe to enter the same.

By the proposed concept a solution is on hand which satisfy an increased demand for a customisable fit of the shoe through lacing. The different sets of openings in the knitted shoe upper structure allow the user to position the lace in countless different and individual positions to provide more or less support and tightening respectively in specific areas of the shoe upper.

To realize a reinforcement structure, the openings (holes) can be knitted in the shoe upper part using a specific knitting method. The surrounding edge of the opening can be specifically knitted. Here, a strong Nylon bundy yarn can be used for a reinforcement of the hole perimeter to provide high tensile strength.

Such a high tensile strength Nylon yarn can also be applied into a bottom layer of the knitting structure and can be combined either with further Nylon yarns, polyester yarn, polypropylene yarns or another yarn suitable for knitting.

The shoe upper can be structured in different zones along the longitudinal extension of the shoe upper and namely in a (foremost) vamp, a central region (with the sets of openings) and a (rear) heel region. The mentioned yarns can be used also in those regions. Also the following described yarns can be used.

The shoe upper can comprise a top layer and a base layer which are knitted together.

The top layer can be made of three separate thermoplastic polyurethane (TPU) coated yarns, each of which is 300 Denier consisting of a polyester filament core; the polyester core accounts for 40% of the yarn and the TPU coating is 60%; one overall yarn is classified as a multifilament yarn as many coated filaments are bound together to create one yarn. Additionally, a hotmelt yarn can be used having 150 Denier.

The base layer can be made up of four polyester yarns; two yarns can be of 75 Denier polyester yarns which are twisted together before knitting. Thus, two yarns of 2×75 Denier polyester can be employed. Additionally, a Nylon bundy yarn of 450 Denier can be used.

When, specifically in the central zone of the shoe upper (with the openings), one Nylon bundy yarn is combined with three polyester yarns a high tensile strength is obtained which is beneficial here. Across all zones of the shoe upper a hotmelt yarn can be combined to hold the fibres together.

A preferred embodiment of the invention incorporates mouldable yarns in the upper layer of the knitted structure. These yarns comprise a multi-filament polyester core coated with a thermoplastic material. By the application of heat and pressure these yarns can be moulded once their melting point is achieved, in this case mostly between 140° C. and 180° C. (melting point). After cooling the yarns retain the shape of the mould applied during the heating process. It has been found that during this heat activation process the abrasion resistance of the yarns can be improved compared with the non-activated method. That means that no additional coating is required to provide sufficient abrasion resistance as demanded by cleated footwear.

The top layer of the shoe upper can comprise three separate TPU coated yarns which are knitted together to form one layer.

The semi-permeable membrane is known as such. It is known for example as "GORE-TEX®" membrane. Here, often polytetrafluorethylene (PTFE) is used as a material for the membrane. The pores of this material allow passing of water vapour. However, liquid water molecules are bigger so that they cannot pass the membrane.

In the drawings an embodiment of the invention is shown.

Figure 2:
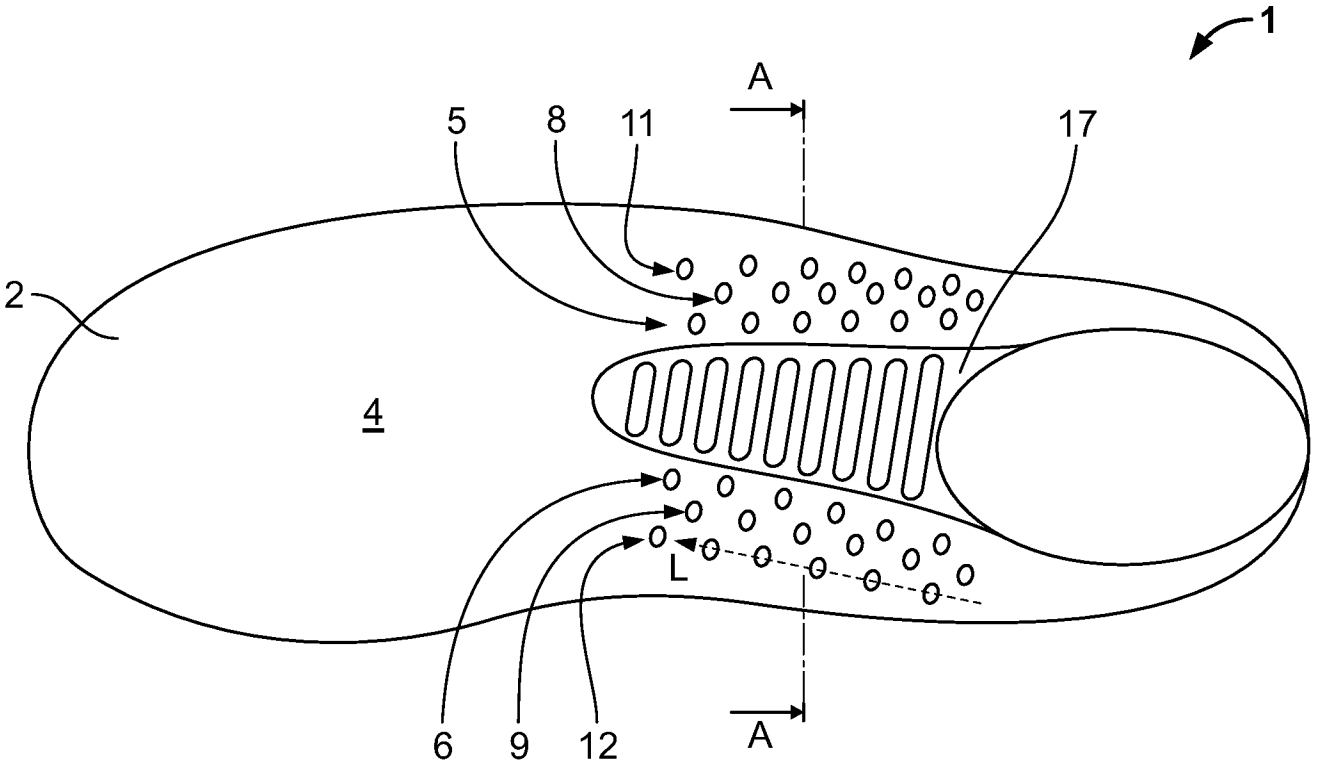
Figure 3:
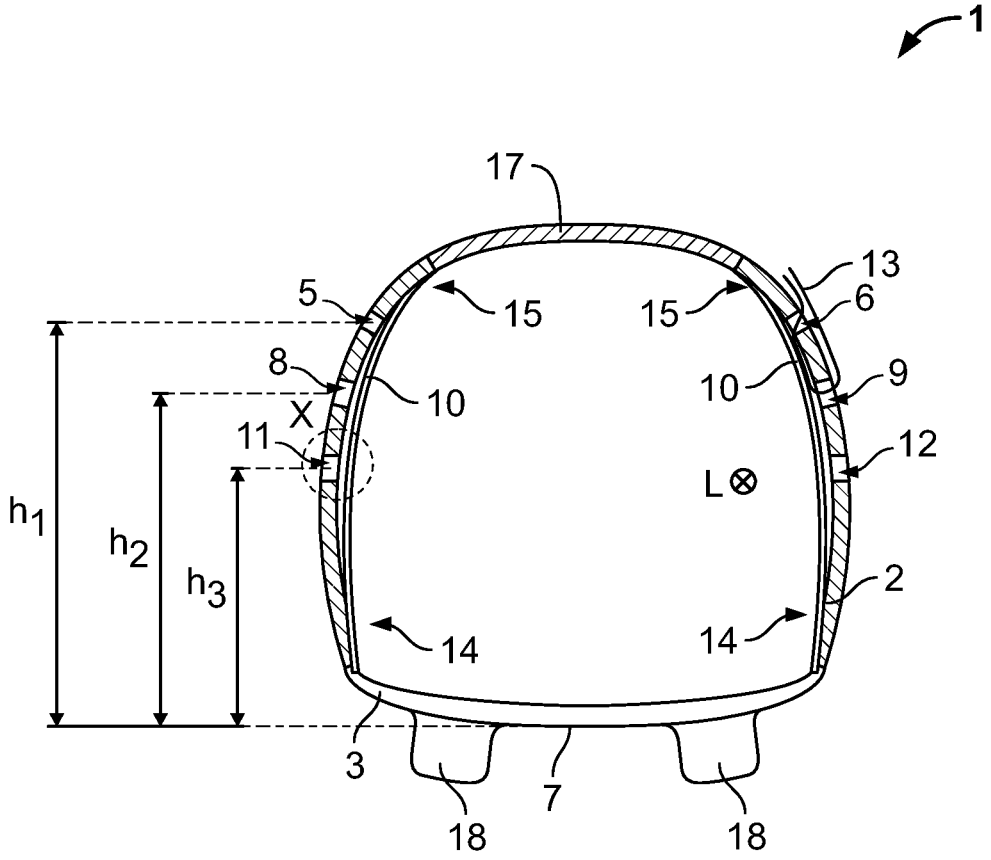
Figure 5:
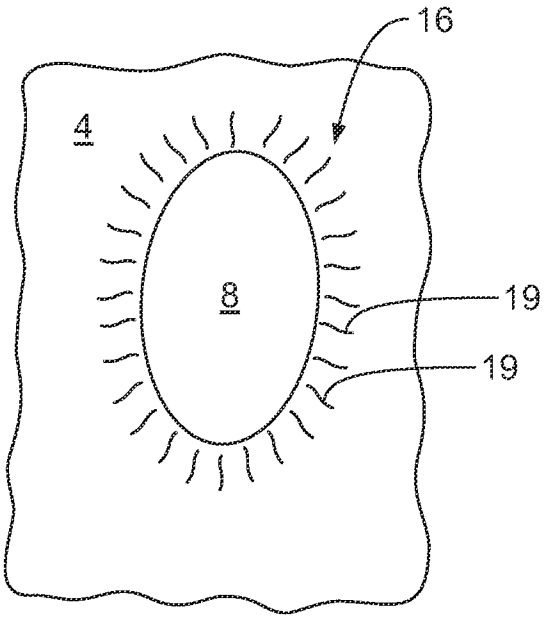
Figure 4:
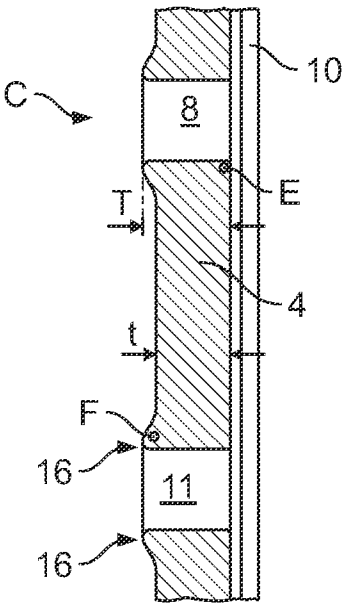

FIG. 1 shows a side view of a soccer shoe according to the invention,

FIG. 2 shows a top plan view of a soccer shoe of a similar shoe as in FIG. 1, FIG. 3 shows the section A-A according to FIG. 2 through the shoe, FIG. 4 shows the detail "X" according to FIG. 3, FIG. 5 shows the view "C" according to FIG. 4 and FIG. 6*a*, FIG. 6*b*, FIG. 6*c* and FIG. 6*d* show schematically different stitching of the knitting process which illustrate the creation of the shoe upper and certain parts of the same.

In FIG. 1 a shoe 1 is shown being a soccer shoe. It has a shoe upper 2 and a sole 3 which is connected with the shoe upper 2. The sole 3 has a bottom 7 and a plurality of cleats 18 which are arranged at the bottom side of the sole 3. The shoe upper 2 is made of a knitted structure 4 which is well known in the art of manufacturing of sports shoes. The knitted structure 4 is connected with a collar 17. Also the collar 17 is made by a knitting process and then connected with the knitted structure 4. The connection can be carried out by a knitting or stitching process; also other connection methods are possible (like glueing or heatbonding).

The shoe 1 is depicted in FIG. 2 in a top plan view; FIG. 3 shows the cross section A-A according to FIG. 2. It should be noted that the shoe 1 according to FIG. 1 and the shoe according to FIG. 2 are not identical but very similar.

As can be seen from the synopsis of the FIGS. 1 to 3 the knitted structure 4 comprises a first set of openings 5 arranged side by side along a longitudinal extension L of the shoe upper 2 at a lateral side of the shoe upper 2; also it has a first set of openings 6 arranged side by side along the longitudinal extension L of the shoe upper at a medial side of the shoe upper 2. Both sets of first openings 5 and 6 are arranged in a defined first height level h1 (see FIG. 3) of the shoe upper 2 measured from the bottom 7 of the sole 3.

Furthermore, the knitted structure 4 comprises a second set of openings 8 arranged side by side along the longitudinal extension L of the shoe upper 2 at the lateral side of the shoe upper 2 and a second set of openings 9 arranged side by side along the longitudinal extension L of the shoe upper 2 at the medial side of the shoe upper 2; both sets of second openings 8 and 9 are arranged in a defined second height level h2 (see FIG. 3) of the shoe upper 2 measured from the bottom 7 of the sole 3. The second height level h2 is different from the first height level h1.

It should be mentioned here that the longitudinal extension L of the respective set of openings corresponds substantially with the longitudinal extension of the whole shoe but is not identical with the same. As can be seen in FIG. 1 the depicted direction of the longitudinal extension L is slightly inclined to the horizontal direction. Often the angle of the inclination is quite small (below 10°). In this case the single openings 5, 6, 8, 9 are following one after the other in a row along the depicted direction L along the outer surface of knitted structure and basically in a horizontal direction. In this case the respective height levels h1, h2 can be easily determined. In the depicted case of a more inclined longitudinal direction the height levels h1, h2 are to be understood that a row of openings 5, 6, 8, 9 is arranged above or below an adjacent row of such openings. This becomes quite clear apparent form FIG. 3.

The same applies when—as in the case of the shown embodiments—a third set of openings 11 at the lateral side and a third set of openings 12 at the medial side of the shoe upper is arranged (see FIGS. 2 and 3; in FIG. 1 a further, fourth, set of openings is shown but not denoted).

Additionally, and this can be seen best in FIG. 3, a semi-permeable membrane 10 is arranged between the foot of the wearer and the knitted structure 4 which covers the openings 5, 6, 8, 9 of the knitted structure 4.

Due to the arrangement of at least two rows of openings 5, 6, 8, 9, 11, 12 on the lateral and on the medial side of the shoe upper 2 an array of openings is created which allows a flexible and individual threading of a lace 13 as shown specifically in FIG. 1. The lace 13 can be guided through an individual selection of openings to obtain the most appropriate and convenient fit of the shoe at the foot of the wearer. In FIG. 1 it can be seen how the lace 13 is guided along the outer surface of the shoe upper 2 and how the lace is guided below the knitted structure 4 (dotted lines). So, an individual lacing of the shoe can be realized.

At the other hand, the membrane 10 is fixed (e. g. glued or heatbonded) at the knitted structure 4 only in a bottom region 14 and a top region 15 of the shoe upper as shown in FIG. 3. The membrane 10 can also be fixed (e. g. glued or heatbonded) in a forefoot and heel region of the shoe upper 2 to the knitted structure 4. However, in the array which is formed by the different sets of openings 5, 6, 8, 9, 11, 12 the membrane 10 is not connected with the knitted structure 4 to allow the mentioned threading of the lace 13. This is shown in FIG. 3.

The openings 5, 6, 8, 9, 11, 12 are mostly designed as round or oval apertures in the knitted structure 4. The maximum diameter is mostly between 3 mm and 7 mm, preferably between 4 mm and 6 mm. The distance between two openings 5, 6, 8, 9, 11, 12 along the longitudinal extension L is mostly between 3 mm and 7 mm, preferably between 4 mm and 6 mm. The distance between one height level h1, h2, h3 (see FIG. 3) is mostly between 8 mm and 12 mm, preferably between 9 mm and 11 mm. One set of openings along the direction L has preferably between 7 and 14 openings. Also up to 5 sets of openings can be arranged at both the lateral and the medial side of the shoe upper 2.

This allows not only a sensitive selection of the optimal lacing openings. Also due to the array of the openings a sufficient area of openings is created which allow vapour to escape from the inner of the shoe through the membrane 10 to the outside of the shoe.

To obtain a high mechanical stability of the openings 5, 6, 8, 9, 11, 12 the edge of the knitted structure which forms the opening 5, 6, 8, 9, 11, 12 can be reinforced. This is depicted in FIGS. 4 and 5. The thickness of the base material of the knitted structure 4 is denoted with t. In the mentioned edge regions of an opening an increased thickness T can be provided to increase here the mechanical stability. The thickness T can be 120% or more of the thickness t. So, a reinforced structure 16 is obtained.

The increased thickness can be created by a knitting process in which additional meshes 19 are knitted in said region along the circumference of an opening. Also the density of meshes 19 can be increased here.

A specific and preferred embodiment of the aspect is the following: The circumference of the openings can be reinforced in the mentioned manner, e. g. with additional or denser meshes. A yarn or combination of yarns can be used for the knitting process which has thermoplastic behavior. In this case it is possible to flatten the surface of the knitted structure before mounting the same into the shoe by means of a heat process (like an ironing process). In this case the outer surface of the knitted structure will be flat (i. e. no bigger thickness T) but the material in the surrounding region of an opening is compressed and has a higher mechanical stability.

The outer surface of the knitted structure 4 can additionally be coated or a printing can be applied.

The knitted upper 4 can also be provided with a surface structure like reinforcement ribs or the like. This can specifically be taken in consideration in the forefoot region to stiffen the soccer shoe here.

A preferred embodiment of the knitted structure 4 comes up with two layers, i. e. a top layer arranged at the outer surface of the shoe upper and a bottom layer facing the foot of the wearer. The top layer can be made of yarns coated with thermoplastic material; these yarns contain a multifilament core with an outside coating. Those yarns are thus fusable by application of heat and pressure. Those yarns require no additional film coating to provide sufficient abrasion resistance. The bottom layer of the knitted structure 4 consists preferably of a minimum of two different yarn types, preferably of polyester and Nylon bundy; this provides a high tensile strength.

With regard to the knitting technique of the shoe upper 2 FIGS. 6*a* to 6*d* (showing schematically the guidance of the yarn by the needles in a knitting machine) illustrate a preferred embodiment of the present invention.

Figure 6B:
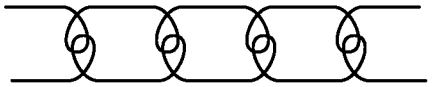
Figure 6D:
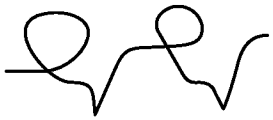
Figure 6A:
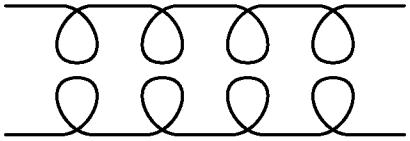
Figure 6C:
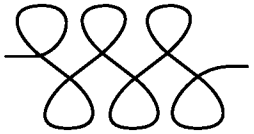

In general a two layer structure is given for the knitted structure 4, i. e. a top layer and a base (bottom) layer. For the knitting of the top and base layer a flat knitting texture is created as shown in FIG. 6*a*. Connection stitches as shown in FIG. 6*d* are used to connect the top and the base layer. By doing so the knitting structure 4 is created in the opening-free regions as illustrated by "D" in FIG. 1.

For the creation of the edges of the openings 5, 6, 8, 9, 11, 12 a different knitting technique is used: Locking stitches as illustrated in FIG. 6*b* are used at the back edge of the hole structure, as illustrated by "E" in FIG. 4. However, locking stitches at the front edge of the hole structure, as illustrated by "F" in FIG. 4 are used.

The knitting process is electronically controlled in the knitting machine by a respective knitting program. Here, the locking stitches for the back edge and for the front edge of the hole structure are programmed as well as for knitting the opening as such (fly stitches to create the openings, i. e. no catching of the hook on this pass) and for the creation of the flat knitting texture.

The membrane 10 can be laminated to another textile structure (carrier structure) and can be affixed to the knitted structure 4 by a stitching process.

A specifically preferred embodiment of the membrane 10 and its attachment to the knitted structure 4 is the following:

The membrane 10 as such is, as mentioned above, preferably laminated to a separate (textile) structure (carrier structure). The membrane 10 as such has preferably a thickness between 0.015 mm and 0.025 mm, specifically preferred 0.02 mm, which is quite small regarding the used on an article of cleated footwear due to the high physical demands placed on the footwear during use.

The membrane is thus laminated with a (textile) structure (carrier structure) to enhance mechanical stability. By doing so, the laminated membrane with its (textile) carrier structure can be positioned loosely under a protective upper layer (knitted structure 4) which has the openings to allow for the passing of water vapour.

The single layer membrane 10 has preferably a moisture permeability of 600 to 800 g/m2 24 hrs, preferably of 700 g/m2 24 hrs. The (knitted) structure (carrier structure) is chosen in such a manner that the laminate of (knitted) structure and membrane 10 has a moisture permeability between 450 and 550 g/m2 24 hrs, preferably of 500 g/m2 24 hrs.

As a benchmark test a TPU skin with hotmelt can be applied on a base textile, which is a typical construction for cleated footwear; the breathability and waterproof level of this specimen is compared with the same textile laminated with the membrane 10. Both of these material packages are incorporated into a finished shoe to count for any heating and cementing processes during the assembly process.

The specimens are tested using ASTM E96-95 BW (23° C., 50% relative humidity) standard (test for water vapour transmission).

By using the above preferred structure, i. e. the laminate consisting of membrane 10 on the (knitted) carrier structure, delivered a clear benefit of the proposed structure. It can be said that on average there is 770% more breathability when using the proposed membrane laminate compared with common TPU skins with hotmelt.

The connection between the shoe upper 2 and the sole 3 can be done by all known techniques.

During the assembly process of the shoe a full board lasted technique can be employ as well as a half board lasted and half strobel technique.

To sum up the proposed article of cleated footwear comprises a knitted structure, combining a plurality of different yarn filaments. The knitted upper component includes a plurality of openings that allow for a wide range of lacing combinations. The openings in the lateral and medial region of the shoe upper allow an airflow to the inner of the shoe. The inner lining construction is a combination of a lining material laminated to a breathable and water resistant membrane. The inner layer lining construction is attached to the knitted outer component at the proximal and distal end of the knitted structure by stitching. This method of attachment avoids damage to the membrane layer.

The shoe upper consists preferably of two components, i. e. the base part of the shoe upper and a (separately) knitted collar region. The collar comprises a polyester and spandex yarn to provide a stretchable opening to receive the foot of the wearer. The collar can comprise different yarns twisted with the spandex yarn depending on the requirements. This stretchable collar is connected to the non-stretchable shoe upper part. This non-stretchable part of the shoe upper comprises a variety of yarns knitted in two layers. The top layer can consist of a single yarn type, the bottom layer can comprise different yarn types to provide strength to the upper component.

REFERENCE NUMERALS

1 Shoe
2 Shoe upper
3 Sole
4 Knitted structure
5 First set of openings (lateral)
6 First set of openings (medial)
7 Bottom of the sole
8 Second set of openings (lateral)
9 Second set of openings (medial)
10 Semi-permeable membrane
11 Further set of openings (lateral)
12 Further set of openings (medial)
13 Lace
14 Bottom region of the shoe upper
15 Top region of the shoe upper
16 Reinforced structure
17 Collar
18 Cleat
19 Meshes
L Longitudinal extension
h1 First height level
h2 Second height level
h3 Third height level
t Thickness of the base material of the shoe upper
T Thickness of the reinforced structure

The invention claimed is:

1. A shoe comprising a shoe upper and a sole which is connected with the shoe upper, wherein the shoe upper comprises a first knitted structure comprising a knitted base material with a first plurality of meshes, the first plurality of meshes having a first density, wherein the first knitted structure at least partially surrounds a foot of a wearer during intended use of the shoe, wherein the first knitted structure comprises a first set of openings arranged side by side along a longitudinal extension (L) of the shoe upper at a lateral side of the shoe upper and a first set of openings arranged side by side along the longitudinal extension (L) of the shoe upper at a medial side of the shoe upper, wherein both sets of first openings are arranged in a defined first height level (h1) of the shoe upper measured from a bottom of the sole, wherein the first knitted structure comprises a second set of openings arranged side by side along the longitudinal extension (L) of the shoe upper at the lateral side of the shoe upper and a second set of openings arranged side by side along the longitudinal extension (L) of the shoe upper at the medial side of the shoe upper, wherein both sets of second openings are arranged in a defined second height level (h2) of the shoe upper measured from the bottom of the sole, wherein the second height level (h2) is different from the first height level (h1), wherein the openings of both sets of first openings and both sets of second openings are adapted to thread a lace therethrough, wherein a semi-permeable membrane is arranged between the foot of the wearer and the first knitted structure which covers the openings of both sets of first openings and both sets of second openings of the first knitted structure, and wherein the shoe upper comprises a knitted reinforced structure including a portion of the first knitted structure and a second knitted structure added to the portion of the first knitted structure, the second knitted structure having a second plurality of meshes, and the knitted reinforced structure having a second density, wherein the knitted reinforced structure encloses at least a part of the openings of both sets of first openings and both sets of second openings, wherein the knitted reinforced structure includes a portion of the first plurality of meshes and a portion of the second plurality of meshes such that that the knitted base material of the shoe upper has a base thickness (t) and that the kitted reinforced structure has an increased thickness (T), wherein the increased thickness (T) of the knitted reinforced structure, is arranged along a circumference of at least one opening, and wherein the semi-permeable membrane is connected with the shoe upper in a bottom region and in a top region and is not connected with the shoe upper in the region of the openings of both sets of first openings, and both sets of second openings.

2. The shoe of claim 1, characterized in that the semi-permeable membrane allows the flow of moisture and water vapour from the foot of the wearer through the semi-permeable membrane and via the openings of both sets of first openings and both sets of second openings to an outer side of the shoe upper and prevents the transfer from moisture from the outer side of the shoe upper to the foot of the wearer.

3. The shoe of claim 1, characterized in that the first knitted structure comprises at least one more set of third openings arranged side by side along the longitudinal extension (L) of the shoe upper at the lateral side of the shoe upper and at least one more set of third openings arranged side by side along the longitudinal extension (L) of the shoe upper at the medial side of the shoe upper, wherein both sets of third openings are arranged in a defined height level (h3) of the shoe upper measured from the bottom of the sole.

4. The shoe of claim 3, characterized in that the openings of both sets of first openings, both sets of second openings, and both sets of third openings are adapted to receive a lace threaded therethrough.

5. The shoe of claim 3, wherein the semi-permeable membrane is not connected with the shoe upper in the region of both sets of third openings.

6. The shoe of claim 1, characterized in that the semi-permeable membrane comprises polysulphone (PSU), polyether sulphone (PES), polyether imide (PI), polytetrafluorethylene (PTFE) or polyamide (PA).

7. The shoe of claim 1, characterized in that the increased thickness (T) is at least 120% of the base thickness (t).

8. The shoe of claim 1, characterized in that a collar is arranged in an instep region of the shoe upper.

9. The shoe of claim 8, characterized in that a stretchability of the collar is at least twice as high as a stretchability of the material of the shoe upper beyond the collar.

10. The shoe of claim 8, characterized in that the collar is manufactured separately from the rest of the shoe upper and is connected with the rest of the shoe upper.

11. The shoe of claim 1, characterized in that it is a soccer shoe, wherein the sole comprises a plurality of cleats.

12. The shoe of claim 1, characterized in that the increased thickness T surrounds the entirety of the circumference of at least one opening.

13. A shoe comprising a shoe upper and a sole which is connected with the shoe upper, wherein the shoe upper comprises a first knitted structure comprising a knitted base material with a first plurality of meshes, the first plurality of meshes having a first density, wherein the first knitted structure at least partially surrounds a foot of a wearer during intended use of the shoe, the knitted structure including a first region and a second region, wherein the first region comprises a first set of openings arranged side by side along a longitudinal extension (L) of the shoe upper, wherein the first set of opening are arranged in a defined first height level (h1) of the shoe upper measured from a bottom of the sole, wherein the first region comprises a second set of openings arranged side by side along the longitudinal extension (L) of the shoe upper, wherein the second set of openings are arranged in a defined second height level (h2) of the shoe upper measured from the bottom of the sole, wherein the second height level (h2) is different from the first height level (h1), wherein the openings of the first and second set of openings are adapted to thread a lace therethrough, wherein a semi-permeable membrane is arranged between the foot of the wearer and the first knitted structure, the semi-permeable membrane covering the openings of the first and second set of openings, and the semi-permeable membrane being connected to the knitted structure at the second region, wherein the semi-permeable membrane is not connected with the knitted structure at the first region, and wherein the shoe upper comprises a knitted reinforced structure including a portion of the first knitted structure and a second knitted structure added to the portion of the first knitted structure along a circumference of at least one opening of the first and second sets of openings.

14. The shoe of claim 13, wherein the knitted reinforced structure encloses at least a part of the openings of the first and second sets of openings.

15. The shoe of claim 13, wherein the knitted base material of the shoe upper has a base thickness, and the knitted reinforced structure has an increased thickness that is greater than the base thickness.

16. The shoe of claim 13, wherein the lace extends from a first opening of the first and second sets of openings to a second opening of the first and second sets of openings, between the first knitted structure and the semi-permeable membrane.

17. The shoe of claim 13, wherein the first region comprises a third set of openings arranged side by side along the longitudinal extension (L) of the shoe upper wherein the third set of openings are arranged in a defined height level (h3) of the shoe upper measured from the bottom of the sale.

18. The shoe of claim 13, the increased thickness is at least 120% of the base thickness.

19. The shoe of claim 13, wherein a collar s arranged in an instep region of the shoe upper.

20. The shoe of claim 1, wherein the lace is guided from one opening to another opening between the knitted structure and the semi-permeable membrane.

* * * * *